US005653348A

United States Patent [19]

MacDonald

[11] Patent Number: 5,653,348

[45] Date of Patent: Aug. 5, 1997

[54] ARCUATE PEG BOARD

[76] Inventor: Paul MacDonald, 17 Moors Cir., Scituate, Mass. 02066

[21] Appl. No.: 434,593

[22] Filed: May 4, 1995

[51] Int. Cl.[6] ..... A47F 5/08

[52] U.S. Cl. ..... 211/87.01; 211/88.01

[58] Field of Search ..... 211/189, 59.1, 211/57.1, 88, 87; 40/657, 493; 403/393, 399, 386, 375; 248/349.1, 152

[56] References Cited

U.S. PATENT DOCUMENTS

| | | | |
|---|---|---|---|
| 2,814,894 | 12/1957 | Horton | 40/63 |
| 3,080,067 | 3/1963 | Lind | 211/176 |
| 3,223,247 | 12/1965 | Bleed | 211/163 |
| 3,258,237 | 6/1966 | Beiman | 248/225 |
| 3,695,455 | 10/1972 | Larson | 211/78 |
| 3,908,949 | 9/1975 | Larson | 248/223 |
| 4,304,382 | 12/1981 | Jelen | 248/221.1 |
| 4,441,619 | 4/1984 | Gibitz | 211/60 T |
| 4,480,755 | 11/1984 | Cartwright | 211/60 T |
| 4,753,495 | 6/1988 | Swink | 312/114 |
| 5,009,334 | 4/1991 | Bodkius | 211/54.1 |
| 5,083,669 | 1/1992 | Wisehart | 211/70.6 |
| 5,209,451 | 5/1993 | Vierling | 248/551 |

*Primary Examiner*—Kenneth J. Dorner
*Assistant Examiner*—Curtis Cohen
*Attorney, Agent, or Firm*—Morse, Altman & Benson

[57] ABSTRACT

An arcuate peg board comprising a cylindrical panel with a plurality of regularly spaced apertures, a rotating pedestal upon which the panel is vertically mounted, a removable U-shaped handle at the upper end of the panel, a compartmented tray removably mounted to the upper end of the panel, and a plurality of movable fixtures for holding tools and components of various shapes and sizes. The fixtures include a tube, a bin, a slot, a shoulder, a magnet, and a hook.

23 Claims, 12 Drawing Sheets

ARCUATE PEG BOARD

BACKGROUND OF THE INVENTION

1. Field of the Invention

The present invention relates to an apparatus for organizing and storing parts of varying shapes and sizes. More particularly, the present invention relates to an apparatus for organizing and storing hand tools and small hardware components.

2. The Prior Art

Prior art devices for organizing and storing hand tools and small hardware components consists of flat perforated panels, toolboxes, and tool carts.

The typical flat perforated panel is a wooden or fiberboard sheet attached to a wall. The sheet contains a plurality of regularly spaced holes into which supports are positioned. The tools and components are placed on or hung from the supports. The flat perforated panel suffers primarily from the drawback that the maximum size of the panel, which relates directly to the number of tools and components that can be organized and stored, is the area of wall available for the panel. A small wall area means a small panel, even though the person may have as many or more tools than the person with a large wall area, thus requiring that some tools and components be stored remotely from the workbench, making them inconvenient.

The typical prior art flat perforated panel also needs to be mounted with spacers to offset the panel from the wall. This is necessary because of the space needed behind the panel for mounting the supports. As a result, the panel must be permanently mounted to the wall. Because the panel is permanently mounted, the rear of the panel is not accessible. Therefore, in order for the supports to be easily reconfigurable, they must be installed from the front only, using gravity and the friction between the support and the wall and back surface of the panel to hold the supports in place. Eventually, the supports can become loose and are easily dislodged when installing or removing the tool or component.

Another consequence of having the panel permanently mounted to the wall is that the rear surface of the panel, which is inaccessible, cannot be used for storage. All components to be stored on the panel must be stored on the front surface.

The typical toolbox is a box with a hinged top and a removable, segmented tray that rests on small shelves that extend inwardly from the walls of the toolbox. Although the tray typically has compartments for separately storing some small components, it is small, so most of the items are stored in the large common area of the box. Thus, the toolbox suffers primarily from the drawback that it is difficult to keep tools and small components organized and easy to find.

The typical tool cart is a stack of heavy metal drawers mounted on wheels. The tool cart can effectively organize tools and components, but takes up a large amount of floor space and may not be near the workbench.

Thus, there continues to be a need for a device for effectively storing and organizing small tools and components, and that can do so in a space-efficient manner.

SUMMARY OF THE INVENTION

The primary object of the present invention is to provide an apparatus for storing and organizing tools and small components that is space-efficient. In one embodiment, the present invention includes an arcuate panel with a plurality of regularly spaced apertures, flanges with openings for mounting the panel to a wall, a plurality of fixtures for holding tools and components of various shapes and sizes, and, optionally, a removable, compartmented tray mounted on the upper end of the panel. In another embodiment, the present invention includes a cylindrically arcuate panel with a plurality of regularly spaced apertures, a rotating pedestal on which the panel is vertically mounted, a removable handle at the upper end of the panel, a removable, compartmented storage tray mounted on the upper end of the panel, and a plurality of fixtures for holding tools and components of various shapes and sizes.

Preferably, in the first embodiment, the panel is composed of a narrow-gauge sheet of material that is bowed into an arcuate shape of up to 180°. The material can be a metal, a plastic, or other similar material. A pair of coplanar flanges extend either inwardly or outwardly from the two straight vertical edges of the panel. The flanges contain up-side-down keyhole-shaped openings for easily mounting and removing the present invention from the wall. The apertures are circular holes about 3/16 inches in diameter and are located in a 1-inch square pattern over substantially the entire surface of the panel.

The optional storage tray has a base and a plurality of compartments of various shapes and sizes attached to the top of the base. A lower portion of the base has a radius smaller than the inner radius of the panel and the upper portion has a radius larger than the inner radius of the panel. The smaller radius portion is inserted into the upper end of the panel and the shoulder created at the junction of the smaller and larger radius portions keeps the tray from completely entering the panel. The upper surface of the tray contains various shapes and sizes of compartments for storing small tools and components.

In the preferred second embodiment, the panel is composed of a pair of semicircular panel components of the first embodiment. A means is employed to connect the edges of the components to form a single cylinder. The apertures are circular holes about 3/16 inches in diameter and are located in a 1-inch square pattern over substantially the entire surface of the panel.

The pedestal has a stationary foundation that rests on a horizontal surface and a table that is rotationally mounted to the foundation at its center. One open end of the panel is mounted to the upper surface of the table.

Preferably, the handle is an inverted U-shaped rod with a rotating grip located on the center portion. A short length of the ends are bent outward at about right angles. The bent ends are inserted into holes near the upper edge of the panel. The handle is removable by deforming the handle slightly so that the bent ends retract from the holes. The handle can also be stored by removing it as described and then reinstalling it with the handle inside the panel.

The storage tray is circular. A portion of its thickness has a radius smaller than the inner radius of the panel and the remainder of its thickness has a radius larger than the inner radius of the panel. The smaller radius portion is inserted into the upper end of the panel and the shoulder created at the junction of the smaller and larger radius portions keeps the tray from completely entering the panel. The upper surface of the tray contains various shapes and sizes of compartments for storing small tools and components.

The various fixtures include a tube, a bin, a slot, a shoulder, a magnet, and a hook. All but the hook are attached to the panel by means of flanges extending from the fixtures. The flanges have holes that are aligned with the apertures of the panel. A screw and nut combination secures the fixture to the panel. In an alternate attachment mechanism, the flanges can be inserted into the apertures and bent over on the other side of the panel.

The tube fixture is a vertical hollow tube with a closed bottom. The bin fixture has a large area bottom and four relatively short sides. The slot fixture has a small area bottom and four relatively tall sides. The shoulder fixture has two horizontal surfaces, each surface with a hole, where the holes are axially aligned. The magnet fixture is a small box open on one side with a magnet secured inside and protruding from the open side. The magnet fixture can be mounted either horizontally or vertically.

The hook fixture has two components, the hook and the lock block. The hook is a bent rod, where the lower portion of the rod is curved into a shape onto which items can be hung. The upper portion has two opposing right-angle bends, so that the end points upward and there is a short length of the rod that is perpendicular to the upward pointing length. The lock block is a rectangular solid that has a vertical hole in the bottom surface that extends into the block. A semicircular groove in the lower surface extends from the hole to one edge. The block has a threaded hole parallel to the groove that extends from one side of the block to the parallel side. The hook mounts to the panel by inserting the upper portion into one of the panel apertures so that the upper portion points upward. The vertical hole of the mounting block is fitted over the upper portion so that the short horizontal length of the upper portion is seated in the semicircular groove. A screw is inserted through another panel aperture and turned into the threaded hole in the block to hold the block and hook in place.

BRIEF DESCRIPTION OF THE DRAWINGS

For a fuller understanding of the nature and object of the present invention, reference is made to the accompanying drawings, wherein.

DETAILED DESCRIPTION OF THE PREFERRED EMBODIMENTS

Figure 1:
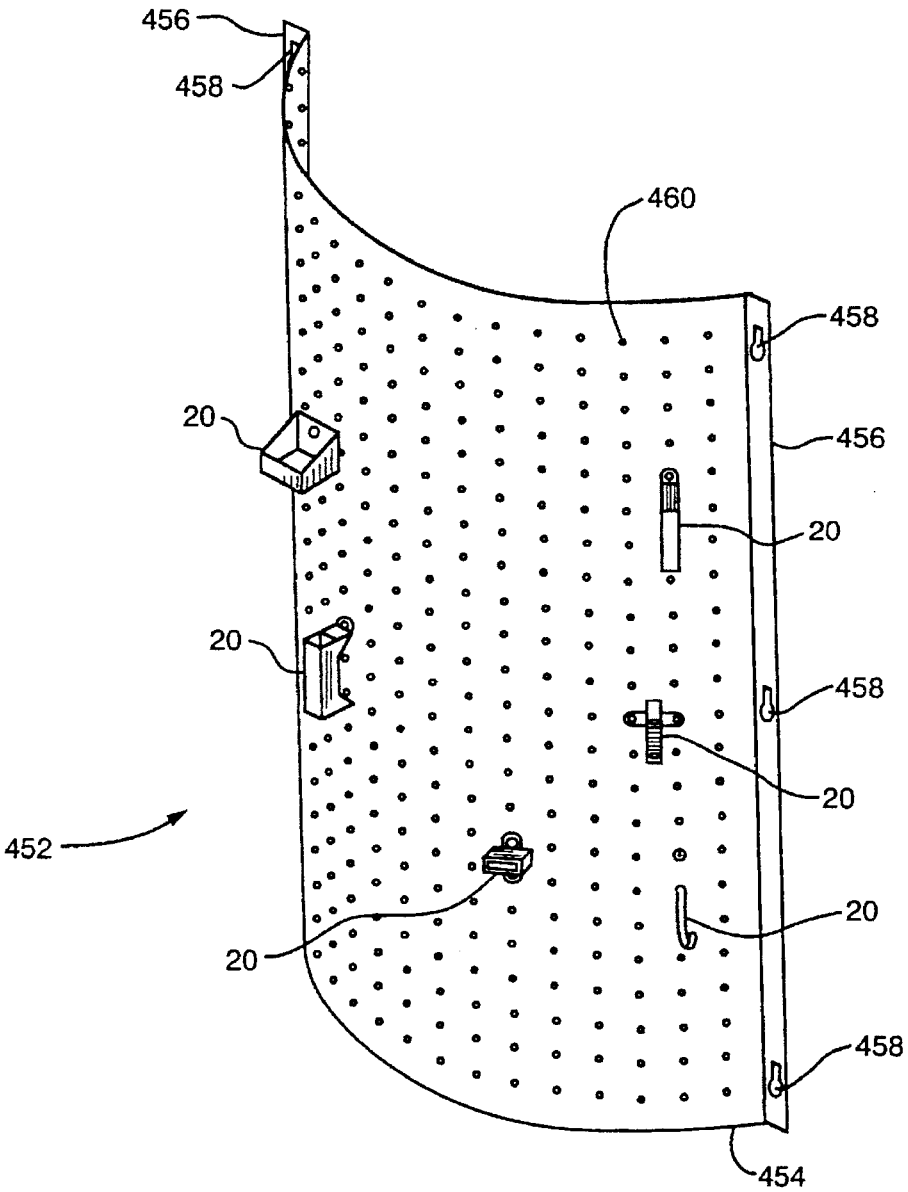
FIG. 1 is a perspective view of the first embodiment of the present invention.
Figure 2:
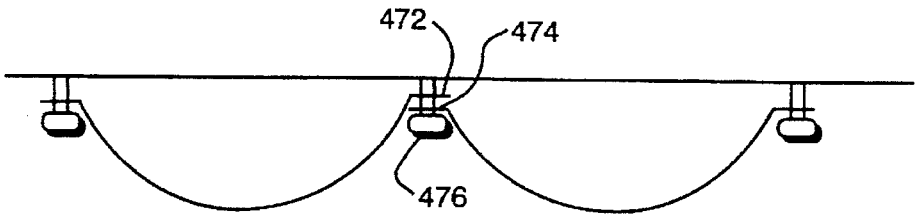
FIG. 2 is a top view of a method for mounting more than one of the present invention of FIG. 1.

The Arcuate Peg Board of FIGS. 1 and 2

FIG. 1 shows a perspective view of the first embodiment of the present invention 452. Preferably, the panel 454 consists of a 20-inch-wide, narrow-gauge sheet of metal that is bent into a arcuate shape such that its linear width is about 16 inches. The 16-inch dimension was chosen because 16 inches is the standard distance between wall studs centers in building construction, and the present invention will be more securely mounted if the mounting hardware has a wall stud to attach to. The arcuate shape, where there is 20 inches of panel surface area in 16 inches of wall space, which amounts to an increase of 25% in the area available for storage. The height of the panel 454 is preferably in the range of from about 12 inches to about 96 inches. The wide range is due to the variety of places in which the present invention can be mounted and the uses to which it can be put.

Extending from the straight vertical edges of the panel 454 are substantially coplanar flanges 456. In one configuration, the flanges extend outwardly and in another configuration, the flanges extend inwardly. The inwardly-extending flanges allow the maximum use of available wall area.

There are a plurality of openings 458, preferably three, in each flange 456 for mounting the panel 454 to a wall, a door, or some other vertical surface. Preferably, each opening 458 is a vertical slot, approximately ¾ inch long, that is wider at the bottom than at the top. The shape of the opening 458 allows the present invention to be removably hung on a vertical surface by screws. The screws are installed in the vertical surface, then the wider bottom portions of the openings 458 are inserted over the head of the screws and the panel 454 is lowered until the narrow upper portions of the openings 458 are resting on the screws between the screw heads and the vertical surface. To remove the panel 454 from the vertical surface, simply lift the panel 454 until the screw heads can be extracted from the wider portion of the openings 458.

Perforating the panel 454 are a plurality of apertures 460. Preferably, the apertures 460 are circular holes about 3/16 inches in diameter and are located in a 1-inch-square grid pattern over substantially the entire surface of the panel 454. Secured to the panel 454 by the apertures 460 are a plurality of fixtures 20. Because the panel 454 can easily be removed and remounted to the vertical surface, there is easy access to the rear of the panel 454. This allows for the use of conventional mounting hardware to mount the fixtures 20, overcoming the problem of needing to rely on gravity and friction to hold the fixtures in place. In addition, the fixtures 20 can be mounted to the rear of the panel 454 for additional storage area. The fixtures 20 are detailed below.

FIG. 2 shows how more than one copy of the present invention configured with outwardly-extending flanges can share common mounting screws. The openings of the right flange 472 of the first copy are installed on the screws 476, then the openings of the left flange 474 of the second copy are installed on the same screws 476. Overlapping the flanges allows for a more space efficient mounting of multiple copies of the present invention.

Figure 3:
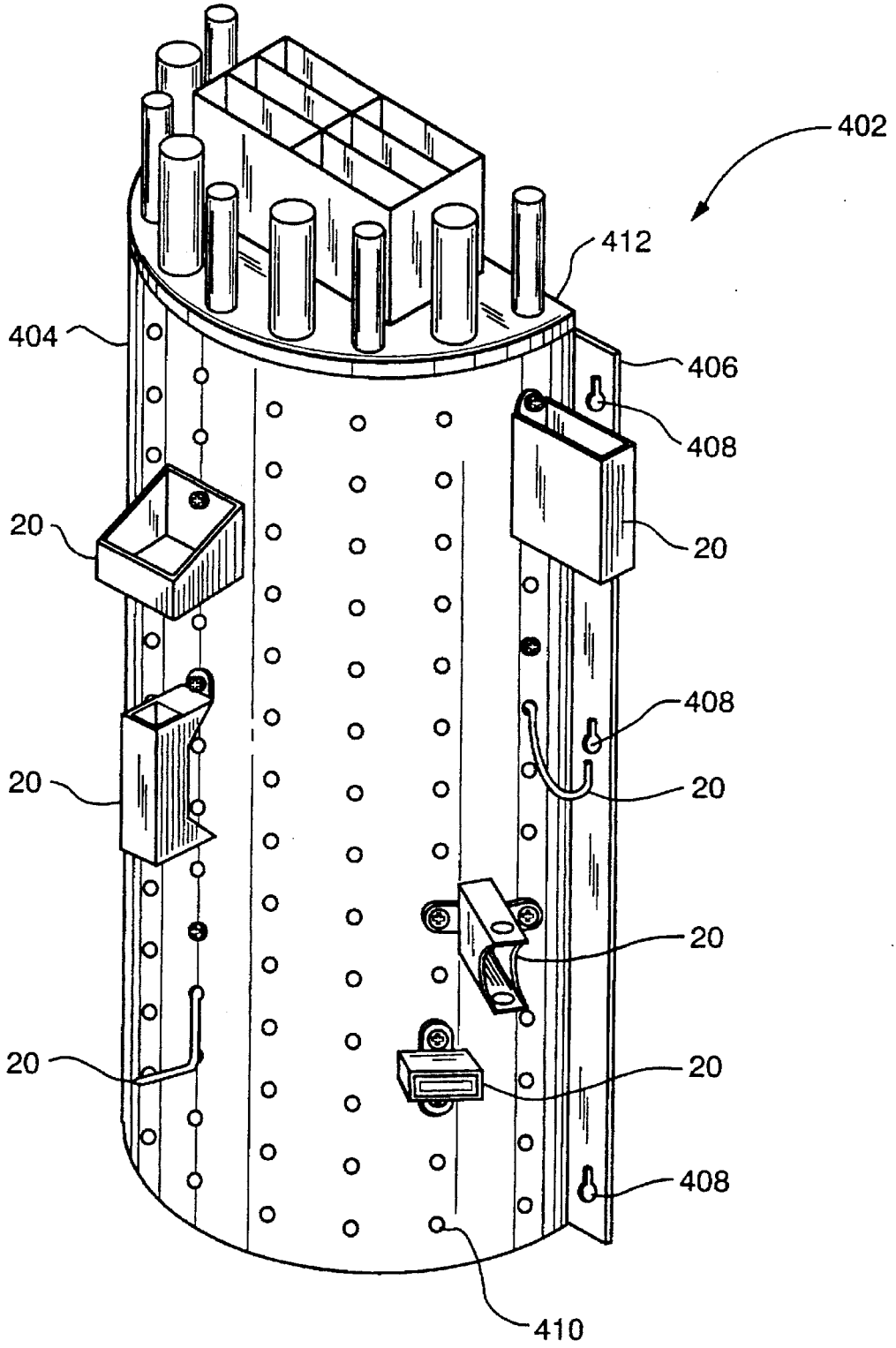
FIG. 3 is a perspective view of another configuration of the first embodiment of the present invention.
Figure 4:
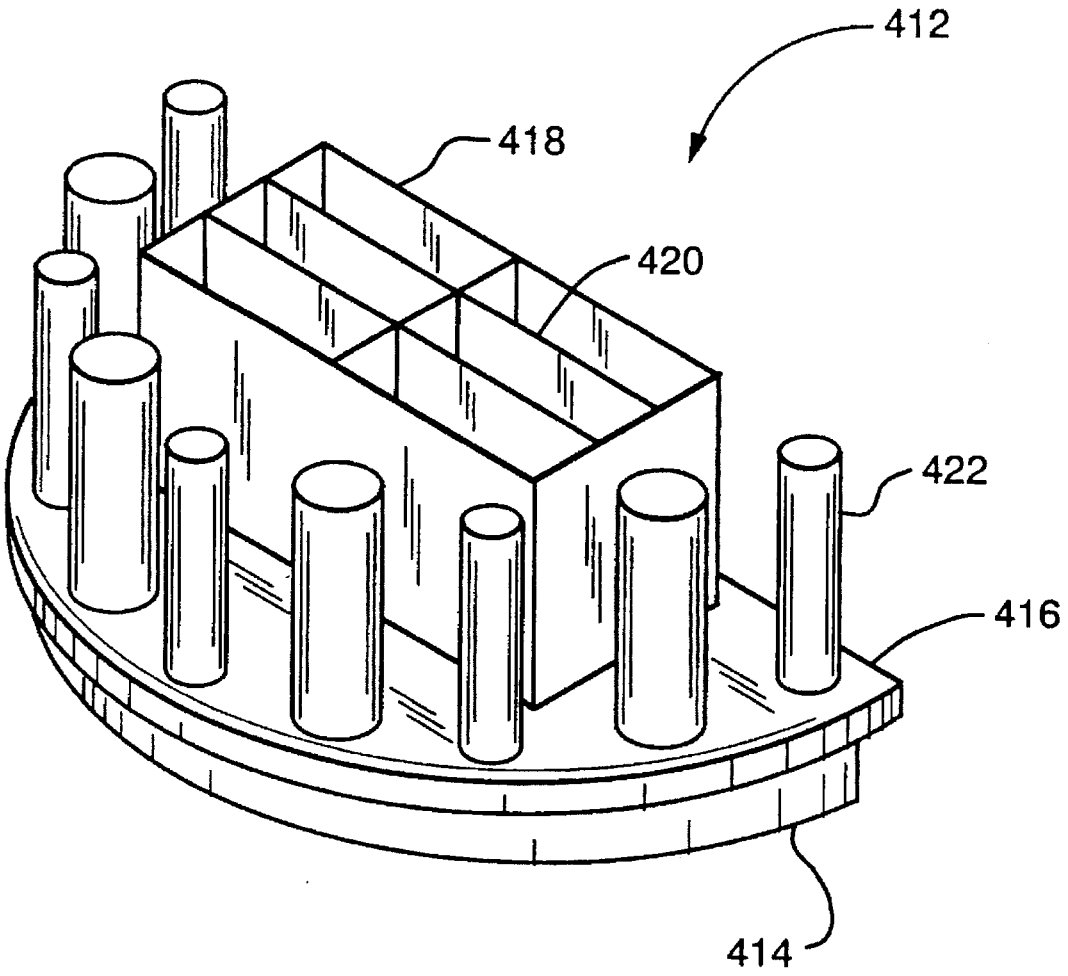
FIG. 4 is a perspective view of the tray of FIG. 3.

The Arcuate Peg Board of FIGS. 3 and 4

FIG. 3 shows a perspective view of another configuration of the first embodiment of the present invention 402. The panel 404 consists of a narrow-gauge sheet of metal that is rolled into a substantially semicircular shape. Extending approximately 90° from the straight vertical edges of the panel 404 are substantially coplanar flanges 406. In one configuration, the flanges extend outwardly and in another configuration, the flanges extend inwardly. The inwardly-extending flanges allow the maximum use of available wall area.

There are a plurality of openings 408, preferably three, in each flange 406 for mounting the panel 404 to a wall, a door, or some other vertical surface. Preferably, each opening 408 is a vertical slot, approximately ¾ inch long, that is narrower at the top than at the bottom. As in the previous configuration of FIGS. 1 and 2, the shape of the opening allows the present invention to be removably hung on a vertical surface by screws.

Perforating the panel 404 are a plurality of apertures 410. Preferably, the apertures 410 are circular holes about 3/16 inches in diameter and are located in a 1-inch-square grid pattern over substantially the entire surface of the panel 404. Secured to the panel 404 by the apertures 410 are a plurality of fixtures 20. As in the previous configuration of FIGS. 1 and 2, because the panel 404 can easily be removed and remounted to the vertical surface, there is easy access to the rear of the panel 404. This allows for the use of conventional mounting hardware to mount the fixtures 20, overcoming the problem of needing to rely on gravity and friction to hold the fixtures in place. In addition, the fixtures 20 can be mounted to the rear of the panel 404 for additional storage area. The fixtures are detailed below.

The tray 412 of FIG. 4 is substantially semicircular with a bottom portion 414 that has a radius slightly less than the radius of the panel 404 and a center portion 416 that has a radius greater than the radius of the panel 404. Projecting from the top surface of the center portion 416 are a variety of holders. Located centrally on the top surface is a box 418, the interior of which is partitioned by a plurality of walls 420. In a semicircle concentric with the outer edge of the central portion 416 are a plurality of vertically mounted tubes 422 of several different heights and diameters. The tubes 422 are open at the top for receiving tools and components.

The Arcuate Peg Board of FIGS. 5 to 11

Figure 5:
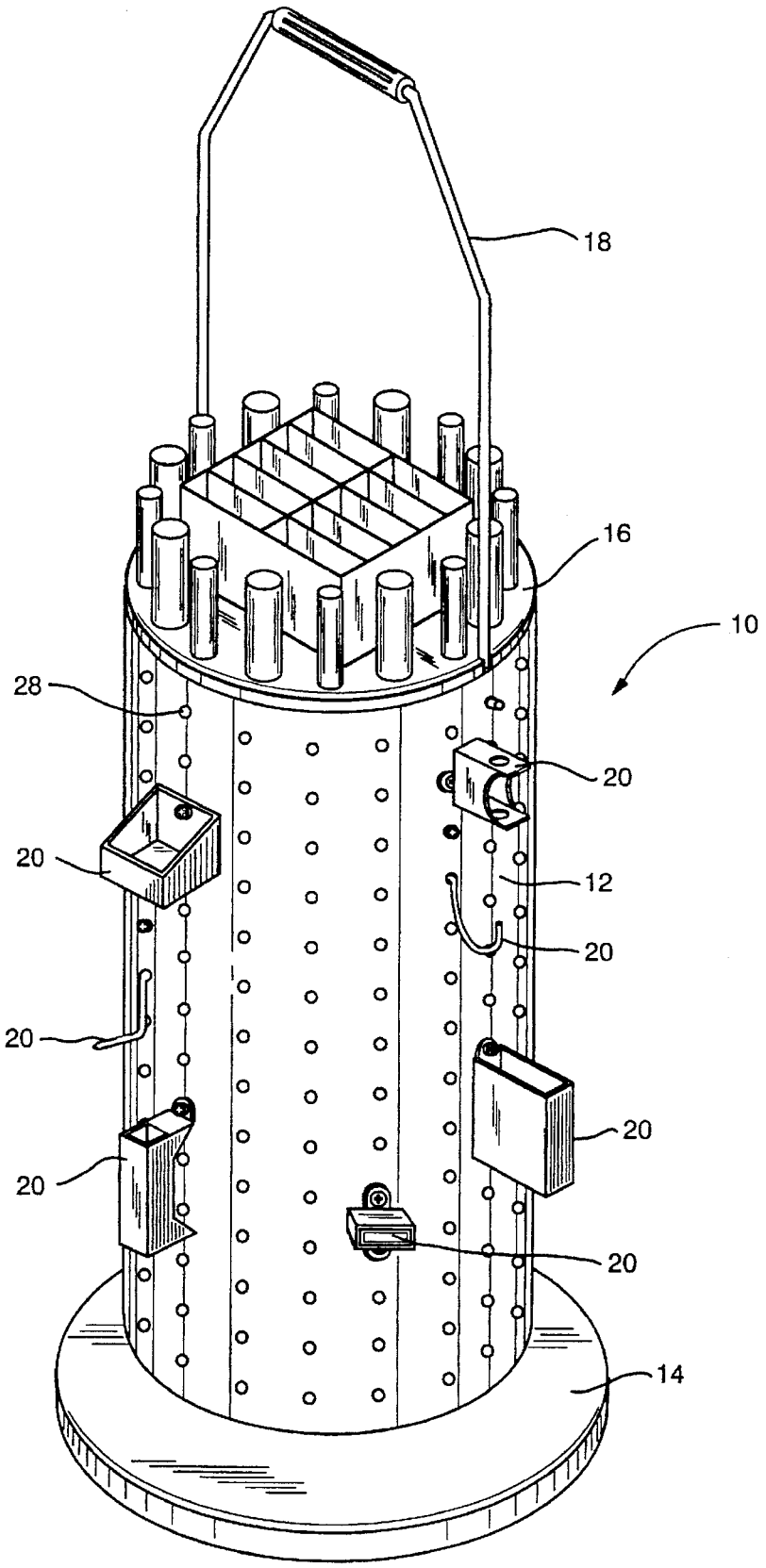
FIG. 5 is a perspective view of the second embodiment of the present invention.

FIG. 5 shows a perspective view of the second embodiment of the present invention. The panel 12 is mounted to the pedestal 14. The tray 16 and the handle 18 are located at the top of the panel.

Figure 6:
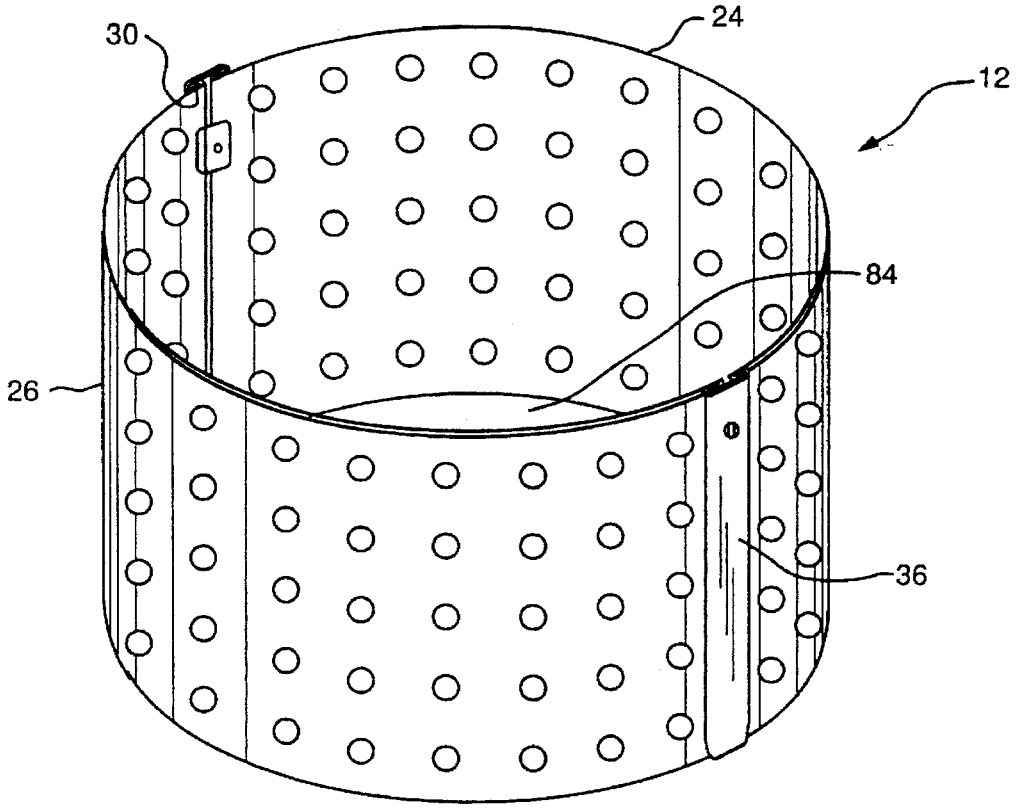
FIG. 6 is a perspective view of the panel of FIG. 5.
Figure 7:
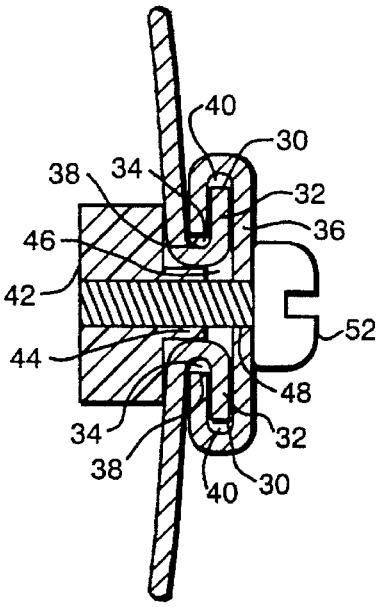
FIG. 7 is a partial cross-section of FIG. 6.
Figure 8:
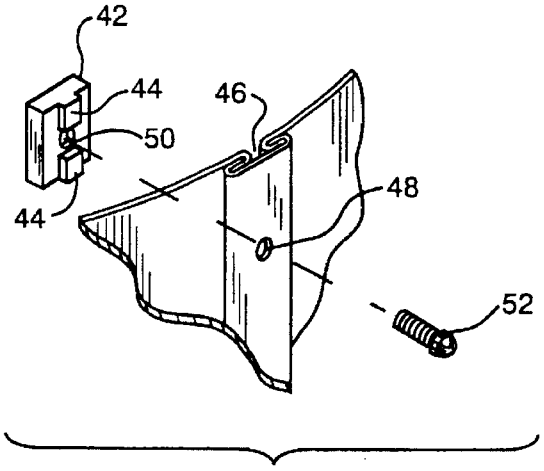
FIG. 8 is a partially exploded view of the joint of FIG. 7.

As seen in FIG. 6, the panel 12 consists of two narrow-gauge sheets of metal that are rolled into semicircular components 24, 26 of substantially identical dimensions and connected to form a cylindrical shape. Preferably, the panel components 24, 26 have a height of between about 18 inches and about 24 inches, and a radius of between about 4 inches and about 6 inches. The mating edges 30 of the panel components 24, 26 are connected along substantially their entire length. As shown in FIG. 7, the mating edges 30 are curled outwardly substantially 180° to form lips 32 that have troughs 34 between the panel component lips 32 and the main surface of the panel components 24, 26. A pair of substantially identical clips 36, with a C-shaped cross-section and a length substantially equal to the length of the panel components 24, 26, are seated such that the lips 38 of the clips 36 fit into the panel component troughs 34 and the panel component lips 34 fit into the clip troughs 40. The rectangular protrusions 44 of a block 42 are seated in the gap 46 between the panel component edges 30. As shown in FIG. 8, a screw 52 is inserted into a hole 48 in the clip 36 and turned into a threaded hole 50 in the block. As the screw 52 is tightened, the protrusions 44 are pulled into the gap 46, forcing the panel component lips 32 tightly into the clip troughs 40.

Perforating the panel 12 are a plurality of apertures 28. Preferably, the apertures 28 are circular holes about 3/16 inches in diameter and are located in a 1-inch-square grid pattern over substantially the entire surface of the panel 12. Secured to the panel 12 by the apertures 28 are a plurality of fixtures 20. Because the panel 12 can accessed from the inside, conventional mounting hardware can be used to mount the fixtures 20. In addition, the fixtures 20 can be mounted inside the panel 12 for additional storage area. The fixtures 20 are detailed below.

Figure 9:
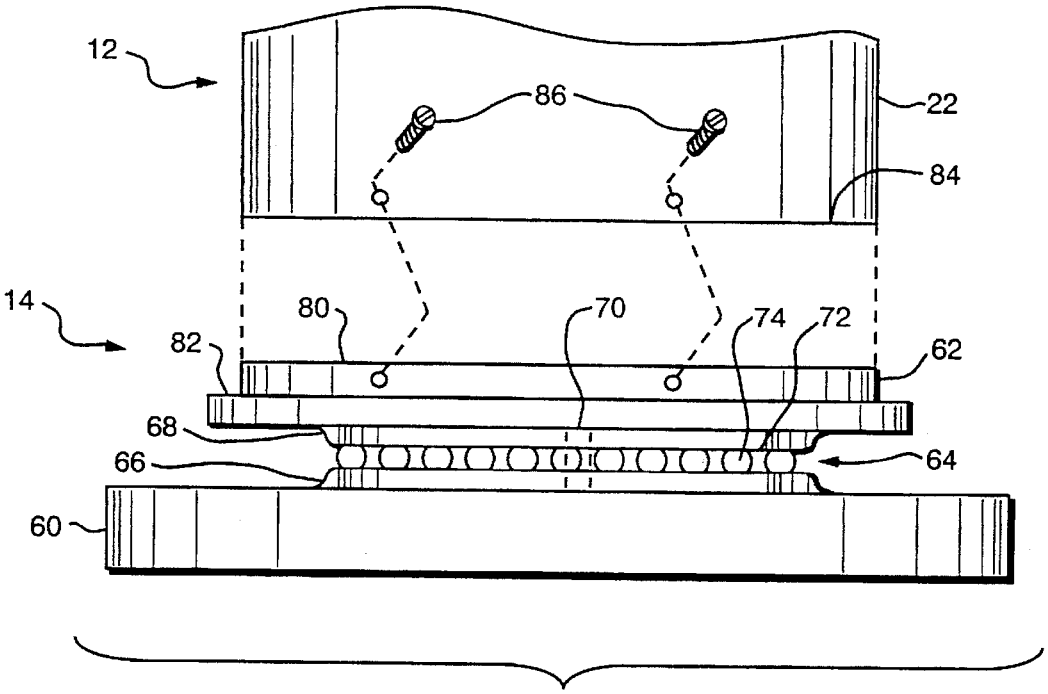
FIG. 9 is a side view of the pedestal of FIG. 5.

As shown in FIG. 9, the pedestal 14 has three components, a foundation 60, a table 62, and a rotational means 64 between the foundation 60 and table 62. The top profile of the foundation 60 can be any shape, but preferably is circular or square. The foundation 60 has a substantially constant thickness. The foundation 60 is stationary and rests on a horizontal surface, such as a bench top. The table 62 has a substantially circular shape and rests on top of the foundation 60, connected to the foundation 60 by the rotational means 64. In the preferred embodiment, the rotational means 64 consist of two round, mating, metal frames 66, 68, where the bottom frame 66 is attached to the top surface of the foundation 60 and the top frame 68 is attached to the bottom surface of the table 62. At the center of the frames 66, 68 is a vertical axis 70 that connects the frames 66, 68 together. The axis 70 allows the frames 66, 68 to rotate relative to each other. Near the outer edge and between the two frames 66, 68 is a circular raceway 72 in which are located a plurality of spherical ball bearings 74. The top frame 68 rides on these ball bearings 74 in order to easily rotate.

The top portion 80 of the table 62 has a diameter substantially equal to the inside diameter of the panel 12. The bottom portion 82 of the table 62 has a diameter larger than the diameter of the panel 12. An open end 84 of the panel 12 fits around the top portion 80 and the larger diameter of the bottom portion 82 prevents the panel 12 from sliding down to the foundation 60. Screws 86 are inserted into holes near the open end 84 of the panel 12 and turned into the edge of the table 62 in order to permanently attach the panel 12 to the pedestal 14.

Figure 10:
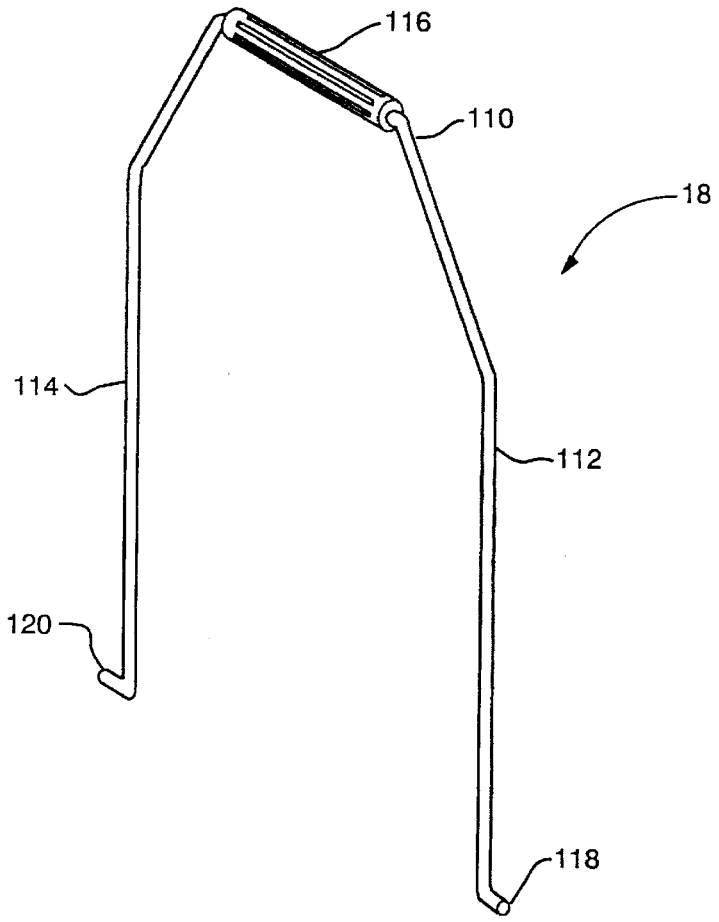
FIG. 10 is a perspective view of the handle of FIG. 5.

The handle 18 of FIG. 10 is a circular-cross-section rod that is bent approximately into the shape of an inverted U. The distance between the outer side of the legs 112, 114 is substantially equal to the inside diameter of the panel 12. Located in the middle of the center portion 110 is a grip 116. The grip 116 is a hollow tube surrounding the center portion 110 that has a knurled outer surface and an inside diameter that allows it to rotate about the center portion 110. Each of the legs 112, 114 has a foot 118, 120 that is at about a 90° angle from the leg 112, 114. The handle 18 is installed by forcing the legs 112, 114 close enough together to permit the feet 118, 120 to fit inside the panel 12, aligning the feet with the handle mounting holes 122, 124 of the panel 12, and releasing the pressure from the legs 112, 114, causing the feet 118, 120 to project into the handle mounting holes 122, 124. The handle 18 is removed by reversing the installation procedure. The handle 18 can be stored by installing it with the grip 116 down inside the panel 12.

Figure 11:
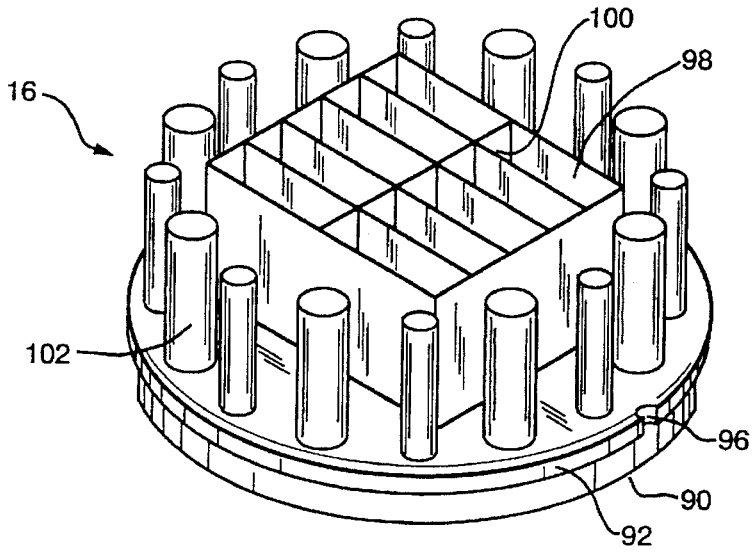
FIG. 11 is a perspective view of the tray of FIG. 5.

The tray 16 of FIG. 11 is substantially circular with a bottom portion 90 that has a diameter substantially equal to the inside diameter of the panel 12 and a center portion 92 that has a diameter greater than the diameter of the panel 12. The edge of the center portion 92 has two notches 96 on opposite sides of the tray 16 that partially encompass the legs of the handle 18 when the handle 18 is installed. Projecting from the top surface of the center portion 92 are a variety of holders. Centrally located on the top surface is a box 98, the interior of which is partitioned by a plurality of walls 100. In a circle concentric with the outer edge of the central portion 92 are a plurality of vertically mounted tubes 102 of several different heights and diameters. The tubes 102 are open at the top for receiving tools and components.

The Fixtures of FIGS. 12 to 20

Figure 12:
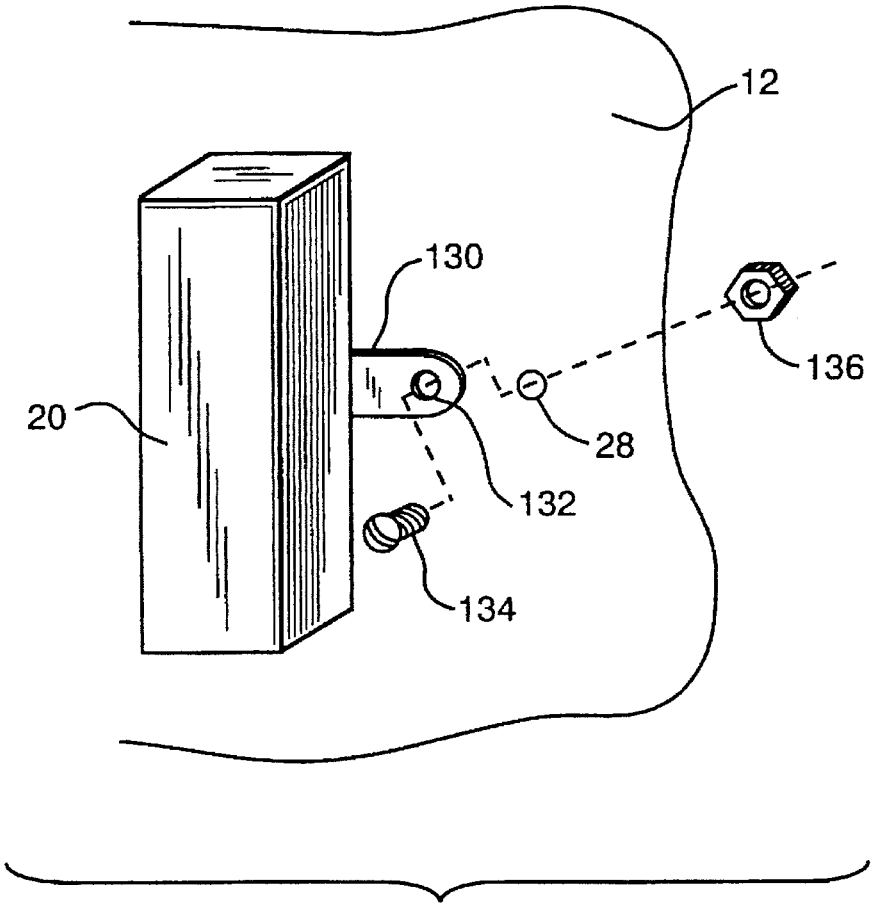
FIG. 12 is an exploded view of one method for the attaching the fixtures to the panel.

FIGS. 12 to 20 show a set of fixtures 20 that are attached to the panel 12 in the same manner. These fixtures 20 include a tube 150, a bin 170, a shoulder 190, a slot 220, and a magnet 240. As shown in FIG. 12, these fixtures 20 are attached to the panel by means of flanges 130 extending from the fixtures 20 such that, when the fixture 20 is placed against the outside surface of the panel 12, the flanges 130 are substantially flush with the panel 12. The flanges 130 have holes 132 that are aligned with the apertures 28 of the panel 12. A screw 134 is inserted through the flange hole 132 and the aperture 28 and secured inside the panel 12 by a nut 136. Alternatively, the fixtures 20 can be mounted in the inside surface of the panel 12.

Figure 13:
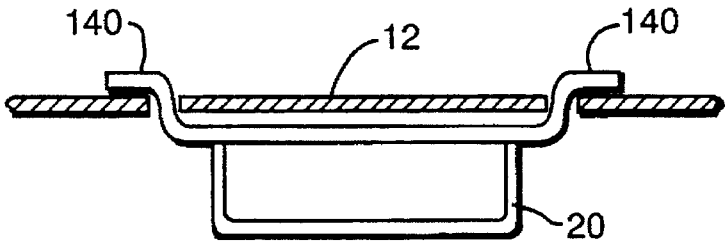
FIG. 13 is a top view of an alternate method for attaching the fixture to the panel.

In an alternate attachment mechanism, shown in FIG. 13, the flanges 140 extend from the fixture 20 such that they can be inserted into the apertures 28 from one side of the panel. The flanges 140 are then bent over on the other side of the panel 12 either manually or using a tool until they are substantially flush with the inside surface of the panel 12. Alternatively, the fixtures 20 can be mounted in the inside surface of the panel 12.

Figure 14:
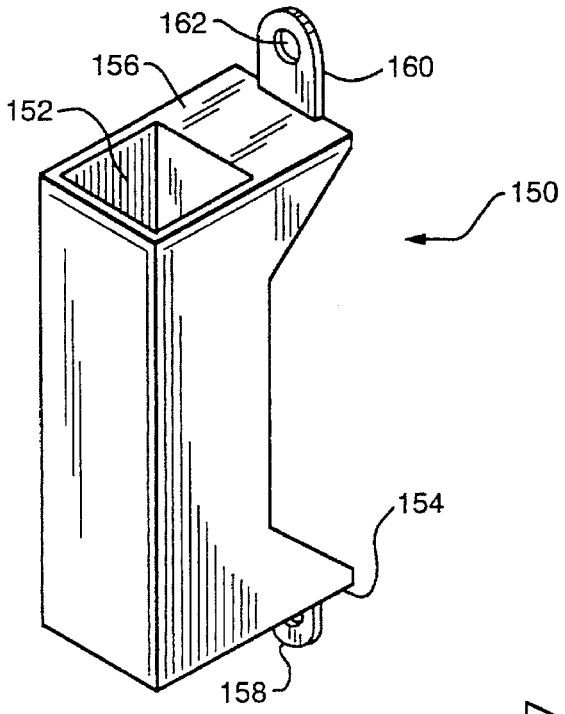
FIG. 14 is a perspective view of the tube fixture.

The tube fixture 150, as shown in FIG. 14, has a vertical hollow tube 152 with a closed bottom. Ears 154, 156 extend horizontally from the bottom and top. A bottom mounting flange 158 extends downwardly from the bottom ear 154 and a top mounting flange 160 extends upwardly from the top ear 156.

Figure 15:
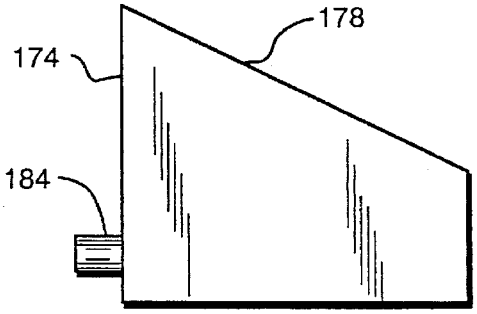
FIG. 15 is a perspective view of the bin fixture.
Figure 16:
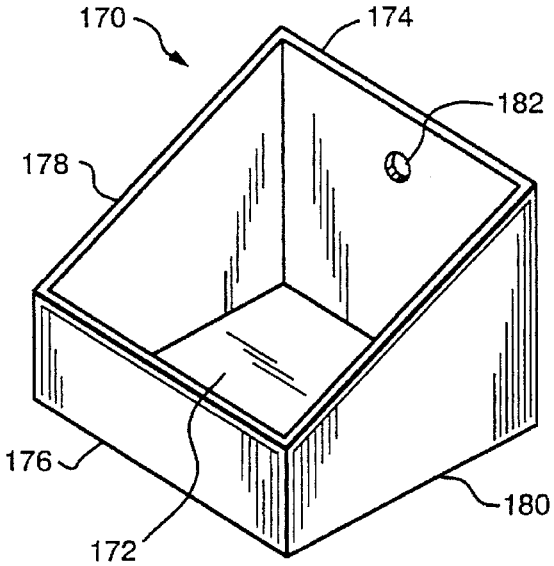
FIG. 16 is a side view of the bin fixture of FIG. 15.

The bin fixture 170, shown in FIGS. 15 and 16, has a rectangular bottom 172 and four connected vertical walls 174, 176, 178, 180. Rather than having a flange with a mounting hole, there is a mounting hole 182 in the rear wall 174 near the top edge and substantially horizontally centered. Protruding rearwardly from the rear wall 174 is a pin 184 that is vertically aligned with and substantially 1 inch below the mounting hole 182. The purpose of the pin 184 is to keep the bin fixture 170 from rotating about the screw used to mount the bin fixture 170 to the panel 12.

Figure 17:
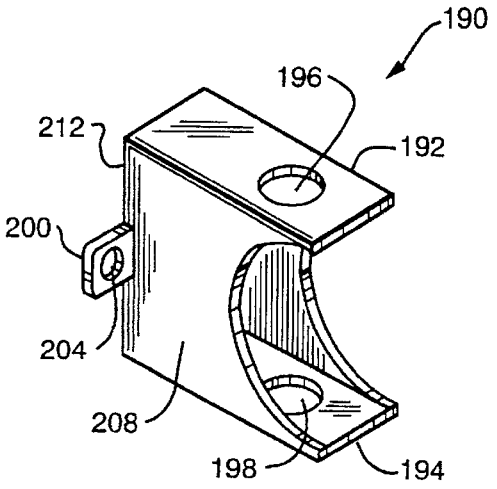
FIG. 17 is a left perspective view of the shoulder fixture.
Figure 18:
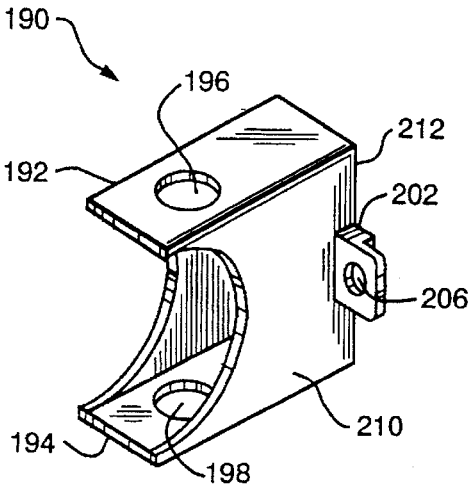
FIG. 18 is a right perspective view of the shoulder fixture of FIG. 17.

The shoulder fixture 190 of FIGS. 17 and 18 has a top 192 and a bottom 194 that are substantially horizontal and spaced apart from each other. The top 192 and bottom 194 are connected to each other by a substantially vertical rear wall 212 and two substantially vertical side walls 208, 210. The top 192 and bottom 194 each has a substantially circular hole 196, 198, where the holes 196, 198 are of substantially the same size and are axially aligned. The flanges 200, 202 extend sideways from the rear wall 212. Each flange 200, 202 has a mounting hole 204, 206. The rear surface of the left flange 200 and the rear surface of the rear wall 212 are co-planar. The rear surface of the right flange 202 is offset forwardly of the surface of the rear wall 212 by the thickness of the left flange 200. The purpose of the offset is to permit the mounting of two shoulder fixtures 190 adjacent to each other by using a common aperture 20 in the panel 12. The right flange 202 of one shoulder fixture 190 overlaps the left flange 200 of the other shoulder fixture and a single screw and nut is used to attach both flanges to the panel 12.

Figure 19:
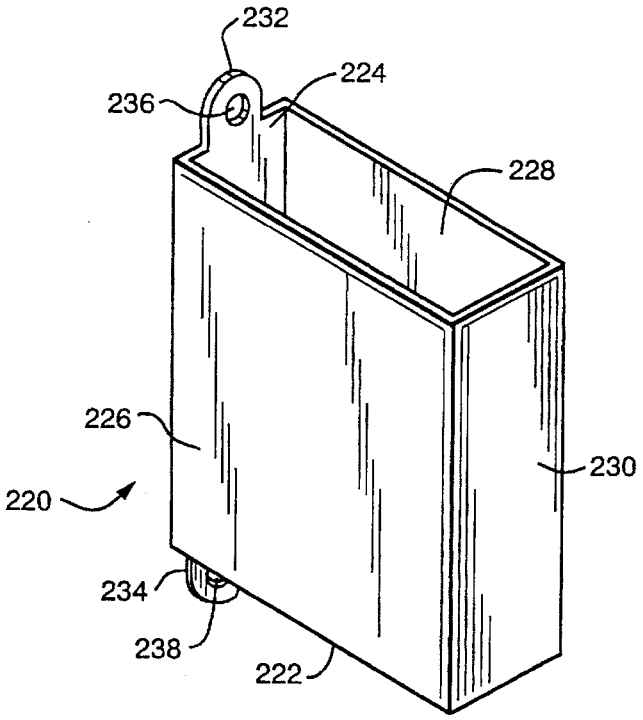
FIG. 19 is a perspective view of the slot fixture.

The slot fixture 220, shown in FIG. 19, has a horizontal rectangular bottom 222 that is at least twice as deep as it is wide and four relatively tall side walls: a rear wall 224, two side walls 226, 228, and a front wall 230. All four walls 224, 226, 228, 230 have substantially the same height. A top mounting flange 232 with a mounting hole 236 extends upwardly from the rear wall 224, and a bottom mounting flange 234 with a mounting hole 238 extends downwardly from the rear wall 224.

Figure 20:
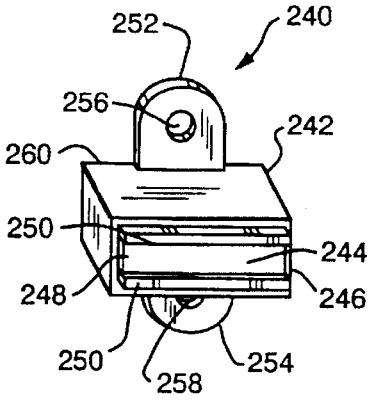
FIG. 20 is a perspective view of the magnet fixture.

The magnet fixture 240 of FIG. 20 includes a substantially rectangular shaped box 242 with an opening on the front side 244. Secured within the box 242 is a magnet 246 such that the magnet 246 protrudes slightly from the opening 244. In the preferred embodiment, the magnet 246 is comprised of a solid rectangular magnetized material 248 and a pair of opposing plates 250 composed of a magnetic material, such as steel or iron. Two flanges 252, 254 with mounting holes 256, 258 extend from opposite sides of and are co-planar with the rear wall 260. The magnet fixture 240 is mounted either horizontally or vertically.

The Hook Fixture of FIGS. 21 to 26

Figure 21:
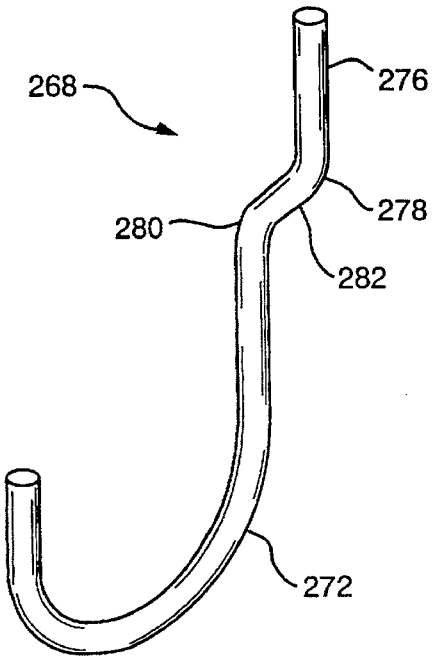
FIG. 21 is a perspective view of one form of the hook.
Figure 22:
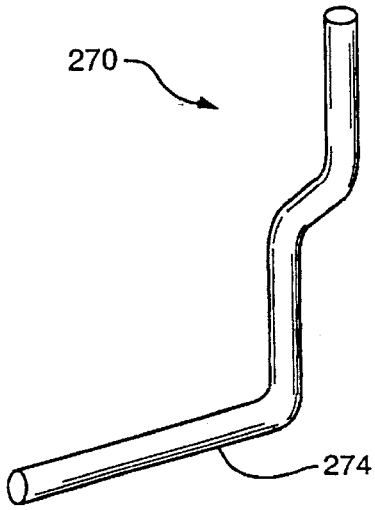
FIG. 22 is a perspective view of another form of the hook.
Figure 23:
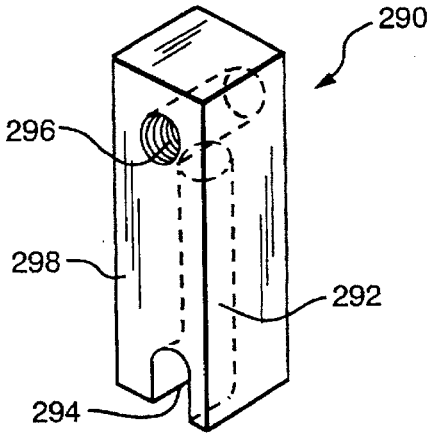
FIG. 23 is a perspective view of the lock block.
Figure 24:
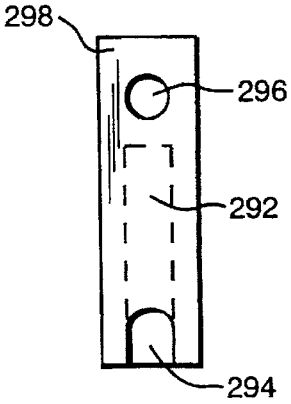
FIG. 24 is a front view of the lock block of FIG. 23.

The hook fixture 266 has two components, the hook 268, 270, shown in FIGS. 21 and 22, and the lock block 290, shown in FIGS. 23 to 24. The hook 268, 270 is a bent rod of substantially circular cross-section. The lower portion 272, 274 of the hook 268, 270 is curved into a shape onto which items can be hung. FIG. 21 shows the lower portion 272 having a substantially semicircular shape and the FIG. 22 shows the lower portion 274 being substantially straight and bent about 120° from vertical.

The upper portion 276 of the hook 268 is separated from the lower portion 272 by two opposing right-angle bends 278, 280 and the center portion 282 defined by the bends 278, 280. The upper portion 276 points substantially upward and the center portion 282 is approximately horizontal.

Figure 25:
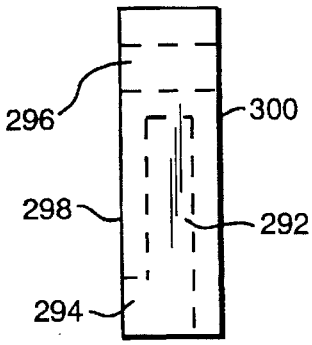
FIG. 25 is a side view of the lock block of FIG. 23.

The lock block 290 of FIGS. 23 to 25 is substantially a rectangular solid that has a vertical hole 292 in the bottom surface that extends vertically into the block 290 a distance of at least the length of the upper portion 276 plus the diameter of the rod. The vertical hole 292 has a substantially circular cross-section and a diameter slightly larger than the diameter of the hook 268. A substantially semicircular groove 294 in the lower surface extends from the vertical hole 292 to the front wall 298. The radius of the groove 294 is substantially equal to half the diameter of the vertical hole 292. The lock block 290 has a threaded hole 296 parallel to the groove 294 that extends from the front wall 298 to the rear wall 300 above the upper end of the vertical hole 292.

Figure 26:
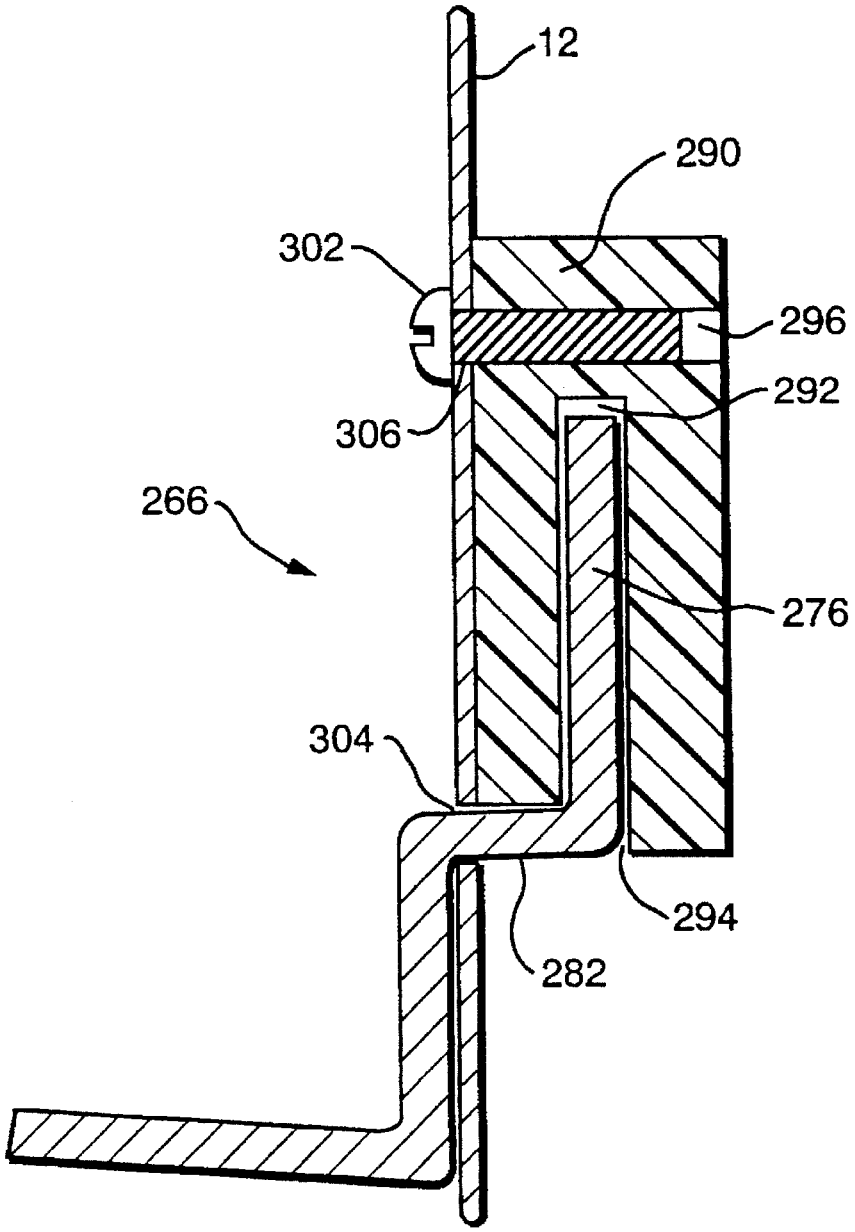
FIG. 26 is a cross-sectional view of how the hook fixture is attached to the panel.

As shown in FIG. 26, the hook fixture 266 mounts to the panel 12 by inserting the upper portion of the hook 276 into one of the panel apertures 304 so that the upper portion 276 points upward and the center portion 282 is straddling the aperture 304. The vertical hole 292 of the lock block 290 is fitted over the upper portion 276 and the lock block 290 is lowered until the center portion 282 is seated in the semicircular groove 294. A screw 302 is inserted through an adjacent panel aperture 306 and turned into the threaded hole 296 to hold the hook fixture 266 in place.

What is claimed is:

1. A peg board comprising:

(a) a cylindrical panel having a bottom end and a top end;

(b) said panel being composed of a pair of substantially identical, semicircular-shaped, narrow-gauge components, the material of said components being selected from the group consisting of a sheet metal and a rigid plastic;

(c) said components being connected by a clip having a length substantially equal to the length of said components and a C-shaped cross-section, said clip mating with curved edges of said components and fastened by a plurality of clamps that force said curved edges outwardly to securely engage said curved edges with said clip;

(d) said panel containing a plurality of apertures arranged in a regular pattern;

(e) a pedestal having a foundation and a table, said foundation and said table being rotationally connected, and said bottom end being mounted on said table;

(f) a tray having a base removably mounted on said top end, said base having an upper surface with a plurality of compartments attached thereto;

(g) a handle removably attached to said top end; and (h) a plurality of fixtures removably attached to said panel.

2. The peg board of claim 1 wherein said apertures are substantially circular and said pattern is a 1-inch-square grid.

3. The peg board of claim 1 wherein said plurality of compartments includes at least one of (1) uncovered boxes, (2) boxes with removable covers, and (3) open-top vertical tubes.

4. The peg board of claim 1 wherein said handle is composed of a substantially circular cross-sectional rod, has substantially the shape of an inverted U with a center portion and two leg portions, the end of said leg portions having feet adapted to be inserted into holes located in said panel, and said center portion being encircled by a rotationally attached hand grip.

5. The peg board of claim 1 wherein said plurality of fixtures includes a bin fixture, said bin fixture including:

(a) a substantially rectangular horizontal base;

(b) four substantially vertical, adjacent walls extending upwardly from said base, one of said walls being a rear wall; and (c) a means for mounting said bin fixture to said panel.

6. The peg board of claim 5 wherein said bin fixture mounting means includes a mounting hole located in said rear wall and an aligning pin protruding rearwardly from said rear wall, whereby said bin fixture is mounted to said panel by inserting said aligning pin into one of said apertures, inserting a screw through said mounting hole and another of said apertures, and tightening a nut onto said screw.

7. The peg board of claim 5 wherein said bin fixture mounting means includes a pair of tabs extending substantially rearwardly from said rear wall, said tabs being adapted for insertion into said apertures and for being bent substantially parallel to said panel surface after being inserted into said apertures.

8. The peg board of claim 1 wherein said plurality of fixtures includes a tube fixture, said tube fixture including:

(a) a substantially square horizontal base;

(b) four substantially vertical, adjacent walls extending upwardly from said base, all of said walls having substantially the same height, and one of said walls being a rear wall;

(c) a pair of ears extending substantially rearwardly and horizontally substantially the same distance from the top and bottom edges of said rear wall; and (d) a means for mounting said tube fixture to said panel.

9. The peg board of claim 8 wherein said tube fixture mounting means includes a pair of flanges, one of said flanges extending substantially upwardly from the rear edge of said top ear and the other of said flanges extending downwardly from the rear edge of said bottom ear, said flanges each containing a mounting hole, whereby said tube fixture is mounted to said panel by aligning said mounting holes with two of said apertures, inserting screws through said mounting holes and apertures, a tightening nuts onto said screws.

10. The peg board of claim 8 wherein said tube fixture mounting means includes a pair of tabs extending rearwardly from the rear edges of said ears, said tabs being adapted for insertion into said apertures and for being bent substantially parallel to said panel surface after being inserted into said apertures.

11. The peg board of claim 1 wherein said plurality of fixtures includes a slot fixture, said slot fixture including:

(a) a substantially rectangular horizontal base, the length of said base being different from the width of said base;

(b) four substantially vertical, adjacent walls extending upwardly from said base, all of said walls having substantially the same height, and one of said walls being a rear wall; and (c) a means for mounting said slot fixture to said panel.

12. The peg board of claim 11 wherein said slot fixture mounting means includes a pair of flanges, one of said flanges extending substantially upwardly from the top edge of said rear wall and the other of said flanges extending downwardly from the bottom edge of said rear wall, said flanges each containing a mounting hole, whereby said slot fixture is mounted to said panel by aligning said mounting holes with two of said apertures, inserting screws into said mounting holes and apertures, and tightening nuts onto said screws.

13. The peg board of claim 11 wherein said slot fixture mounting means includes a pair of tabs extending from said rear wall, said tabs being adapted for insertion into said apertures and for being bent substantially parallel to said panel surface after being inserted into said apertures.

14. The peg board of claim 1 wherein said plurality of fixtures includes a shoulder fixture, said shoulder fixture including:

(a) a substantially horizontal top;

(b) a substantially horizontal bottom spaced from said top;

(c) a substantially vertical rear wall connecting said top and said bottom;

(d) said bottom having a hole;

(e) said top having a hole axially aligned with said bottom hole; and (f) a means for mounting said shoulder fixture to said panel.

15. The peg board of claim 14 wherein said shoulder fixture mounting means includes a left flange extending leftwardly from the left edge of said rear wall, said left flange being co-planar with said rear wall rear surface, and a right flange extending rightwardly from the right edge of said rear wall, said right flange rear surface being parallel to said rear wall rear surface and offset forwardly from said rear wall rear surface by the thickness of said left flange, said flanges each containing a mounting hole, whereby said shoulder fixture is mounted to said panel by aligning said mounting holes with two of said apertures, inserting screws into said mounting holes and apertures, and tightening nuts onto said screws.

16. The peg board of claim 14 wherein said shoulder fixture mounting means includes a pair of tabs extending from the edges of said rear wall, said tabs being adapted for insertion into said apertures and for being bent substantially parallel to said panel surface after being inserted into said apertures.

17. The peg board of claim 1 wherein said plurality of fixtures includes a magnet fixture, said magnet fixture including:

(a) a substantially rectangular hollow frame with a rear wall and an open side opposite said rear wall;

(b) a magnet secured in said frame such that said magnet protrudes from said opening; and (c) a means for mounting said magnet fixture to said panel.

18. The peg board of claim 17 wherein said magnet fixture mounting means includes a pair of flanges extending from two edges of said rear wall, said flanges being co-planar with said rear wall rear surface, said flanges each containing a mounting hole, whereby said magnet fixture is mounted to said panel by aligning said mounting holes with two of said apertures, inserting screws into said mounting holes and apertures, and tightening nuts onto said screws.

19. The peg board of claim 17 wherein said magnet fixture mounting means includes a pair of tabs extending from two edges of said rear wall, said tabs being adapted for insertion into said apertures and for being bent substantially parallel to said panel surface after being inserted into said apertures.

20. The peg board of claim 1 wherein said plurality of fixtures includes a hook fixture, said hook fixture including:

(a) a hook, a lock block, and a screw;

(b) said hook being a rod of substantially round cross-section, and having a lower portion, a middle portion, and an upper portion;

(c) said lower portion being curved;

(d) said middle portion being delimited from said lower portion by a first substantially right-angle bend;

(e) said upper portion being delimited from said middle portion by a second substantially right-angle bend in substantially the opposite direction from said first bend;

(f) said upper portion being substantially straight;

(g) said lock block being a substantially rectangular solid and having a bottom surface, a front surface, and a rear surface;

(h) said block having a rod hole in said bottom surface, said rod hole extending substantially orthogonally into said block a distance at least that of said upper portion plus the diameter of said rod and having a diameter at least that of said rod;

(i) said block having a substantially semicircular groove in said bottom surface from said rod hole to said front surface;

(j) said block having a threaded hole extending through said block from said front surface to said rear surface;

(k) whereby said hook is mounted by inserting said upper portion into one of said apertures until said middle portion straddles said aperture, inserting said upper portion into said rod hole until said middle portion is seated in said groove, and securing said block by inserting said screw through another of said apertures and tightening said screw into said threaded hole.

21. A peg board comprising:

(a) a cylindrical panel having a bottom end and a top end;

(b) said panel being composed of a pair of substantially identical, semicircular-shaped, narrow-gauge components, the material of said components being selected from the group consisting of a sheet metal and a rigid plastic;

(c) said components being connected by a clip having a length substantially equal to the length of said components and a C-shaped cross-section, said clip mating with curved edges of said components and fastened by a plurality of clamps that force said curved edges outwardly to securely engage said curved edges with said clip;

(d) said panel containing a plurality of substantially circular apertures arranged in a 1-inch-square grid;

(e) a pedestal having a foundation and a table, said foundation and said table being rotationally connected, and said bottom end being mounted on said table;

(f) a tray having a base removably mounted on said top end, said base having an upper surface with a plurality of compartments attached thereto;

(g) said plurality of compartments including at least one of (1) uncovered boxes, (2) boxes with removable covers, and (3) open-top vertical tubes;

(h) a handle removably attached to said top end;

(i) said handle being composed of a substantially circular cross-sectional rod;

(j) said handle being substantially the shape of an inverted U with a center portion and two leg portions, the end of said leg portions having feet adapted to be inserted into holes located in said panel, and said center portion being encircled by a rotationally attached hand grip;

(k) a plurality of fixtures removably attached to said panel;

(l) said plurality of fixtures including a bin fixture, a tube fixture, a slot fixture, a shoulder fixture, a magnet fixture, and a hook fixture;

(m) said bin fixture including a substantially rectangular horizontal base, four substantially vertical, adjacent walls extending upwardly from said bin base, one of said bin walls being a bin rear wall, and a means for mounting said bin fixture to said panel;

(n) said tube fixture including a substantially square horizontal base, four substantially vertical, adjacent walls extending upwardly from said tube base, all of said tube walls having substantially the same height, and one of said tube walls being a tube rear wall, a pair of ears extending substantially rearwardly and horizontally substantially the same distance from the top and bottom edges of said tube rear wall, and a means for mounting said tube fixture to said panel;

(o) said slot fixture including a substantially rectangular horizontal base, the length of said slot base being different from the width of said slot base, four substantially vertical, adjacent walls extending upwardly from said slot base, all of said slot walls having substantially the same height, and one of said slot walls being a slot rear wall, and a means for mounting said slot fixture to said panel;

(p) said shoulder fixture including a substantially horizontal top, a substantially horizontal bottom spaced from said shoulder top, a substantially vertical rear wall connecting said shoulder top and said shoulder bottom, said shoulder bottom having a bottom hole, said shoulder top having a top hole axially aligned with said bottom hole, and a means for mounting said shoulder fixture to said panel;

(q) said magnet fixture including, a substantially rectangular hollow frame with a magnet rear wall and an open side opposite said magnet rear wall, a magnet secured in said frame, and a means for mounting said magnet fixture to said panel; and (r) said hook fixture including a hook, a lock block, and a screw;

(s) said hook being a rod of substantially round cross-section, and having a lower portion, a middle portion, and an upper portion, said lower portion being curved, said middle portion being delimited from said lower portion by a first substantially right-angle bend, said upper portion being delimited from said middle portion by a second substantially right-angle bend in substantially the opposite direction from said first bend, and said upper portion being substantially straight;

(t) said lock block being a substantially rectangular solid having a bottom surface, a front surface, and a rear surface, a rod hole in said bottom surface, said rod hole extending substantially orthogonally into said block a distance at least that of said upper portion plus the diameter of said rod and having a diameter at least that of said rod, said block having a substantially semicircular groove in said bottom surface from said rod hole to said front surface, said block having a threaded hole extending through said block from said front surface to said rear surface;

(u) whereby said hook is mounted by inserting said upper portion into one of said apertures until said middle portion straddles said aperture, inserting said upper portion into said rod hole until said middle portion is seated in said groove, and securing said block by inserting said screw through another of said apertures and tightening said screw into said threaded hole.

22. The peg board of claim 21 wherein:

(a) said bin fixture mounting means includes a bin mounting hole located in said bin rear wall and an aligning pin protruding rearwardly from said bin rear wall, whereby said bin fixture is mounted to said panel by inserting said aligning pin into one of said apertures, inserting a screw through said bin mounting hole and another of said apertures, and tightening a nut onto said screw;

(b) said tube fixture mounting means includes a pair of tube flanges, one of said tube flanges extending substantially upwardly from the rear edge of said top ear and the other of said tube flanges extending downwardly from the rear edge of said bottom ear, said tube flanges each containing a tube mounting hole, whereby said tube fixture is mounted to said panel by aligning said tube mounting holes with two of said apertures, inserting screws through said tube mounting holes and apertures, a tightening nuts onto said screws;

(c) said slot fixture mounting means includes a pair of slot flanges, one of said slot flanges extending substantially upwardly from the top edge of said slot rear wall and the other of said slot flanges extending downwardly from the bottom edge of said slot rear wall, said slot flanges each containing a slot mounting hole, whereby said slot fixture is mounted to said panel by aligning said slot mounting holes with two of said apertures, inserting screws into said slot mounting holes and apertures, and tightening nuts onto said screws;

(d) said shoulder fixture mounting means includes a left shoulder flange extending leftwardly from the left edge of said shoulder rear wall, said left shoulder flange being co-planar with said shoulder rear wall rear surface, and a right shoulder flange extending rightwardly from the right edge of said shoulder rear wall, said right shoulder flange rear surface being parallel to said shoulder rear wall rear surface and offset forwardly from said shoulder rear wall rear surface by the thickness of said left shoulder flange, said shoulder flanges each containing a shoulder mounting hole, whereby said shoulder fixture is mounted to said panel by aligning said shoulder mounting holes with two of said apertures, inserting screws into said shoulder mounting holes and apertures, and tightening nuts onto said screws; and (e) said magnet fixture mounting means includes a pair of magnet flanges extending from two edges of said magnet rear wall, said magnet flanges being co-planar with said magnet rear wall rear surface, said magnet flanges each containing a magnet mounting hole, whereby said magnet fixture is mounted to said panel by aligning said magnet mounting holes with two of said apertures, inserting screws into said magnet mounting holes and apertures, and tightening nuts onto said screws.

23. The peg board of claim 21 wherein:

(a) said bin fixture mounting means includes a pair of bin tabs extending substantially rearwardly from said bin rear wall;

(b) said tube fixture mounting means includes a pair of tube tabs extending rearwardly from the rear edges of said ears;

(c) said slot fixture mounting means includes a pair of slot tabs extending from said slot rear wall;

(d) said shoulder fixture mounting means includes a pair of shoulder tabs extending from the edges of said shoulder rear wall; and (e) said magnet fixture mounting means includes a pair of magnet tabs extending from two edges of said magnet rear wall;

(f) said tabs being adapted for insertion into said apertures and for being bent substantially parallel to said panel surface after being inserted into said apertures.

* * * * *